US012042844B2

(12) United States Patent
Stalcup

(10) Patent No.: US 12,042,844 B2
(45) Date of Patent: Jul. 23, 2024

(54) PULL-TYPE FASTENER, METHOD, AND SYSTEM FOR REDUCTION OF DEBRIS

(71) Applicant: ALLFAST FASTENING SYSTEMS, City of Industry, CA (US)

(72) Inventor: Steven Stalcup, City of Industry, CA (US)

(73) Assignee: ALLFAST FASTENING SYSTEMS, City of Industry (CA)

( * ) Notice: Subject to any disclaimer, the term of this patent is extended or adjusted under 35 U.S.C. 154(b) by 92 days.

(21) Appl. No.: 17/970,854

(22) Filed: Oct. 21, 2022

(65) Prior Publication Data

US 2023/0131707 A1 Apr. 27, 2023

Related U.S. Application Data

(60) Provisional application No. 63/270,792, filed on Oct. 22, 2021.

(51) Int. Cl.

| | |
|---|---|
| ***B21J 15/32*** | (2006.01) |
| ***B21J 15/10*** | (2006.01) |
| ***B21J 15/14*** | (2006.01) |
| *B21J 15/02* | (2006.01) |
| *B21J 15/04* | (2006.01) |

(52) U.S. Cl.

CPC ..... *B21J 15/326* (2013.01); *B21J 15/105* (2013.01); *B21J 15/142* (2013.01); *B21J 15/022* (2013.01); *B21J 15/043* (2013.01)

(58) Field of Classification Search

CPC ..... B21J 15/326; B21J 15/105; B21J 15/143; B21J 15/142; B21J 15/30; B21J 15/043; B21J 15/022

See application file for complete search history.

(56) References Cited

U.S. PATENT DOCUMENTS

| | | | | |
|---|---|---|---|---|
| 5,350,264 | A | 9/1994 | Stencel | |
| 5,634,751 | A | 6/1997 | Stencel et al. | |
| 7,857,563 | B2 | 12/2010 | Pratt | |
| 7,966,705 | B2 | 6/2011 | Morris et al. | |
| 8,322,015 | B2 | 12/2012 | Pratt et al. | |
| 9,987,714 | B2 * | 6/2018 | Henderson | B21J 15/32 |
| 10,760,605 | B2 | 9/2020 | Koontz et al. | |
| 10,941,799 | B2 | 3/2021 | Furu-Szekely et al. | |
| 2002/0164203 | A1 | 11/2002 | Sewell | |
| 2005/0163586 | A1 | 7/2005 | Tamashiro et al. | |
| 2013/0239399 | A1 | 9/2013 | Reid et al. | |
| 2014/0201974 | A1 | 7/2014 | Mitchell | |
| 2015/0224612 | A1 * | 8/2015 | Henderson | B21J 15/022 81/55 |
| 2016/0102695 | A1 | 4/2016 | Furu-Szekely et al. | |
| 2019/0048193 | A1 | 2/2019 | Leonh | |
| 2019/0195260 | A1 | 6/2019 | Athas et al. | |
| 2019/0390697 | A1 | 12/2019 | Littlejohn et al. | |
| 2020/0049185 | A1 | 2/2020 | Quaresma | |

FOREIGN PATENT DOCUMENTS

| | | |
|---|---|---|
| WO | 2020056244 | 3/2020 |

* cited by examiner

*Primary Examiner* — Nathaniel C Chukwurah
(74) *Attorney, Agent, or Firm* — McDonald Hopkins LLC

(57) ABSTRACT

A fastener, installing tool, system, and method all contemplate integrated magnetic and/or vacuum traps positioned so as to capture particulates and debris created during the installation and use of the fastener. These elements are integrated into the installing system so as to eliminate the need for additional clamps.

17 Claims, 5 Drawing Sheets

PULL-TYPE FASTENER, METHOD, AND SYSTEM FOR REDUCTION OF DEBRIS

CROSS REFERENCE TO RELATED APPLICATIONS

This application claims priority to U.S. provisional patent application Ser. No. 63/270,792 filed on Oct. 22, 2021, which is incorporated by reference herein.

FIELD OF INVENTION

This disclosure relates to an installation tool for a pull-type fasteners that produces annular and/or multiple fragments of waste material upon installation, as well as a method of using the same. More specifically, the tool and method here reduce or eliminate unwanted metallic objects and debris from remaining on or in the work piece after the fastener is installed.

BACKGROUND

Construction rivets are a particular type of pull fastener commonly used in general manufacturing to hold together a plurality of metal sheets, beams, and other work pieces having aligned apertures (either preformed or drilled/created as part of the installation process). These have a pull pin arranged along the rivet's longitudinal axis. That pin is engaged by a specialized installation tool (e.g., pulled out) so that, as the pin is removed, an outer tube or sleeve expands, with one or more enlarged portions clamping the work pieces together.

The installation action for rivets produces waste in the form of the central pin. However, because the specialized tool already grips or engages that pin, riveting tools can modified to collect the discarded pins by pulling or suctioning the pins into a storage compartment on the tool. In this manner, unwanted debris does not collect on the now-joined work pieces.

Aerospace blind fasteners and blind rivets are a more complex fastener (in comparison to commercial rivets) that are primarily used in the aircraft industry. At present, only three suppliers manufacture these specialized components: Allfast (TriMas), Cherry Aerospace (PCC), and Howmet Fastening Systems. Given this small supply chain, the component manufacturers themselves tend to the sole producer of installation tools, and the rigorous quality demands imposed by the aerospace industry make it infeasible to arbitrarily substitute fasteners and/or installation systems.

Aerospace blind fasteners and rivets are constructed from at least three separate parts (e.g., a sleeve, a pull pin, and a locking ring), and one or more of these parts are specifically engineered to fracture or otherwise be removed and discarded (also by way of a specialized installation tool) after the component is installed. For example, these components provide a locking ring or "anvil," which is effectively an annular washer seated on or formed as part of the head of the pin or bolt in order to facilitate installation of the rivet. As that pin is pulled/manipulated during installation, the anvil fractures at one or more pre-determined fracture points.

As with rivets, this installation process generates numerous small particles and debris. However, unlike the centralized pin collection that can be employed with commercial rivets, the anvil (and possibly other pieces) will separate from the fastener at a location that may not lend itself to the pin collection systems. Further still, some blind fasteners have break bolts where a portion shears or breaks off as part of the installation, thereby giving rise to an additional location (relative to the tool positioning) where fragments and debris may be formed.

If any of this debris (i.e., pins, washers, and/or other metal fragments) is not removed after the rivet or fastener is installed, it creates potential issues when the aircraft later goes into service. And if the joined work pieces seal a portion of the vehicle that will not later be accessible (e.g., the interior void of an aircraft wing, etc.), unwanted noise, unnecessary weight, and even structural damage can result.

At present, extraneous and additional equipment is employed in an effort to reduce or eliminate these particles and debris in aerospace settings. Specifically, clamps including magnetic collector plates have been proposed so as to capture ferromagnetic particles. However, the use of these clamps adds material costs and labor, as they must be installed separately from the installation tool.

For example, U.S. Pat. No. 9,987,714 describes an automated method and system for installing fasteners with frangible collars that are designed to be sheared off by torqueing during the installation process. A vacuum plenum is configured to abut a rotatable installation method so as to collect the unwanted debris. U.S. Pat. No. 7,966,705 and United States patent publication 2013/02399399 provide further insights and background. All of the aforementioned documents are incorporated by reference.

The inventors are also aware of collection collars that can be retrofitted to the installation tool/system at least one aerospace fastener provider. Here, a magnet is over-fitted around the muzzle of the tool in which pulling head is positioned. This adds size and weight to the system, and the reliance on a single magnet makes it critical to align the tool during installation, as gravity alone must cause the magnetized anvil to fall close enough to the collar.

In view of the foregoing, there is a need for a fastener, installing tool, system, and method all of which (singly or in combination) reduce or eliminate debris and particulates created during fastener installation/use without the need for additional clamps or rotating/moving parts. A system that was not reliant upon creating vacuum suction around the work piece and tool (or debris removal system) is also needed. Lastly, a system that is handheld, portable, and preferably retrofitted to existing tools would be welcomed.

SUMMARY OF INVENTION

The invention takes several different aspects, all of which are centered around the ability to provide for the capture of annular and fragmented debris created during the installation of aerospace fasteners in a hand-held tool and/or to retrofit an existing system for the same purposes. The collection methods include provision of magnets at spaced-apart points where the tool head engages the fastener pin. An integral collection bin can also be provided, as well as a collapsible basket, both of which also have magnetic catch points. Vacuum systems can be provided to further enhance and improve the collection system.

BRIEF DESCRIPTION OF THE DRAWINGS

The appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Any printed information on/in the drawings form part of this written disclosure.

In the drawings and attachments, all of which are incorporated as part of this disclosure.

DETAILED DESCRIPTION

Figure 1A:
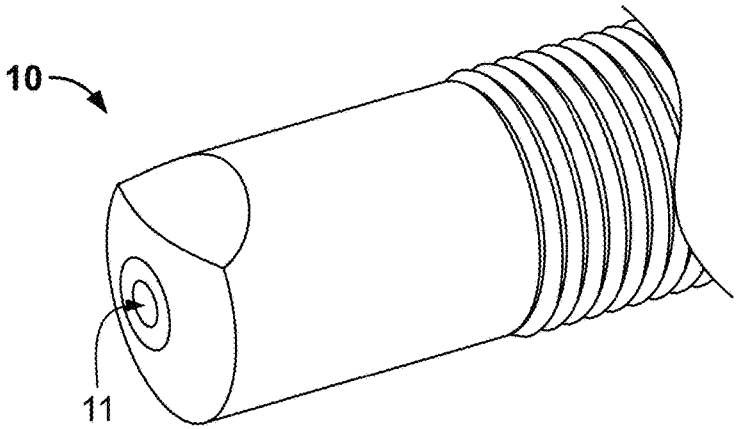
FIG. 1A is a perspective view of a conventional tool head and FIG. 1B is a cross sectional side view of this conventional tool head can grip and engage an aerospace fastener having a pin, sleeve, and detachable (and/or frangible) anvil.

Operation of the invention may be better understood by reference to the detailed description, drawings, claims, and abstract—all of which form part of this written disclosure. While specific aspects and embodiments are contemplated, it will be understood that persons of skill in this field will be able to adapt and/or substitute certain teachings without departing from the underlying invention. Consequently, this disclosure should not be read as unduly limiting the invention(s).

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Similarly, terms such as "user," "operator," and the like should be understood as being interchangeable throughout the subject specification, unless context suggests a particular distinction among the terms. Also, the terms and methods herein may refer to human entities or automated components such as automated robotic assembly devices, including those being controlled by a user, supported through artificial intelligence (e.g., a capacity to make inference), programmed for a particular user, or otherwise. For instance, examples describing installing a rivet may include a human user with a hand held installation device, a human operating a robotic arm having an installation device, an automated machine that utilizes an installation device, etc.

As used herein, a fastener may refer to various types of rivets, screws, bolts, or the like. Such fasteners may comprise metals, plastics, or other materials. For example, fastener may refer to a cylindrical rivet comprising a metal body (e.g., aluminum, steel, etc.). Moreover, embodiments may refer to a specific type of fastener for simplicity of explanation. As such, disclosed aspects may be applicable to various other types of fasteners.

U.S. Pat. Nos. 5,350,264; 5,634,751; 7,857,563; 8,322,015; 10,760,605; and 10,941,799, as well as United States Patent Publications 2002/0164203; 2005/0163586; 2014/0201974; 2016/0102695; 2019/0048193; 2019/0195260; 2019/0390697; and 2020/0049185 and international patent publication WO 2020/056244, all disclose various designs, tools, components, and methods relevant to pull type and other fasteners. Accordingly, these disclosures are all incorporated by reference, so as to more fully inform this disclosure and its inventive features.

The assembly of aerospace structure components employs the use of many fasteners, which will be described in greater detail below. Fastener selection is typically based upon many factors that include desired mechanical properties, accessibility to work piece, and cost. Three exemplary fasteners include aluminum lock bolts, blind fasteners, and solid rivets. These two fasteners each provide benefits and limitations to their use. Alternatives to these fasteners exist but present different limitations to their use. In all cases, aerospace grade fasteners can and must be distinguished from general construction components because the aerospace versions must be of exceptionally high quality, both in terms of the grade of materials and the reliable performance installation of the fasteners themselves. Thus, even where analogies might be drawn between previously known general construction rivets having frangible and discarded components, the conditions in which those general construction rivets are implemented and installed allow the user a much wider degree of freedom (in terms of disposing of debris and selecting the fastener in the first instance) than can be available in aerospace installations.

A lock bolt fastener is a two piece design comprised of a pin and a swageable locking collar. The lock bolt type fasteners are non-blind fasteners. The installation of this fastener is accomplished by inserting a pin into an aperture formed through work pieces to be joined. The locking collar is applied to the pin from the opposite side of the work. An installation tool pulls the pin so that the nose of the tool swages the collar onto the pin creating a mechanical lock with the pin. The pull portion of the pin then fractures and is discarded. One of the disadvantages to the use of lock bolts is that both sides of the work to be joined need to be accessible for installation of the fastener.

Solid rivets are a single component fastener, generally made from aluminum alloys, having a head and a shank. Solid rivets are installed by inserting the fastener into an aperture formed through work pieces to be joined. The rivet is restrained on the head side and force is applied to the opposite side, permanently deforming the terminal end of the rivet. One of the disadvantages to the use of solid rivets is that these fasteners are non-blind so that they require that both sides of the work to be joined are accessible to install the solid fastener Blind fasteners are a particular type of pull-type fastener that may be used where there is limited operating room. Also, these can reduce installation and/or time in comparison to two-piece non-blind fasteners, and they tend to be more readily and cost effectively adapted to automated or robotic installation than would be a two-piece system.

Blind fasteners based on rotary or pull-type actuation are particularly useful. Both are typically composed of multiple components which move and/or separate relative to one another, thereby creating the potential creation of unwanted debris being deposited onto/into the work pieces.

The rotary fasteners provide the desired mechanical properties and require only accessibility to one side of the work piece. The fastener is inserted into the work and the installation tool actuates the pin in a rotary manner. Depending on the particular fastener, a sleeve component deforms against the side opposite of the fastener head (e.g., the blind side) joining the work and applies preload. A drive portion of the pin fractures and is discarded. These fasteners tend to be more costly (e.g., such as due to materials used, manufacturing costs, or the like) and complexity in manufacture. Prevention of galvanic corrosion between the fastener and work material requires coatings that are costly and/or environmentally unfriendly.

Pull-type blind fasteners generally include a drive anvil or washer, a pin and a sleeve. The washer and sleeve have an axial bore therethrough. The pin is assembled through the sleeve and washer. A hollow cylindrical sleeve surrounds the pin between the washer and a head of the pin. In installation, the fastener is aligned in holes in work pieces. As the bolt is drawn through the bore of the nut, the sleeve is pushed by the bolt head and is deformed against the workpieces thus locking the fastener in position.

Once locked, a portion of the pin above the work pieces is removed and discarded, usually by way of a specialized installation tool. This portion typically breaks off from the remainder of the pin. This action can lead to small particles and other debris becoming separated from the final, installed fastener. If this debris is not removed, it can create unwanted hazards and issues in an aircraft or other vehicle, especially to the extent the joined work pieces seal an inaccessible part of the vehicle (e.g., the interior void of an aircraft wing, etc.).

There are two main sources of foreign object debris (FOD) created during installation of aerospace fasteners: portions of the stem and, separately, portions of the driving anvil. These portions fall away from different physical locations on the fastener so that it is not possible to rely on a single, confined particulate collection point or system.

Consequently, the inventors propose to rely upon magnetic and/or vacuum-assisted functionality provided on the installation tool. The magnet portions may be friction fitted into slots, grooves, or other surface formations on the installation tool nose piece, with the magnet being sufficiently strong enough to draw and adhere falling particulates. The particulates can then be brushed or dislodged from the magnets allowing to collect the discarded objects and, possibly, reuse/reinstall the magnet on additional fasteners.

A similar approach can be employed with the installation tool. Here, magnets or suction/vacuum systems would collect the particulates in a designated pouch. The pouch can be positioned on the tool so as to allow gravity to at least initially direct the particulates into the pouch. In other aspects, a simple magnetic plate could be used (with a similar approach as above, in that the magnet can removed, cleaned, and/or replaced on the tool during installation processes).

Figure 1B:
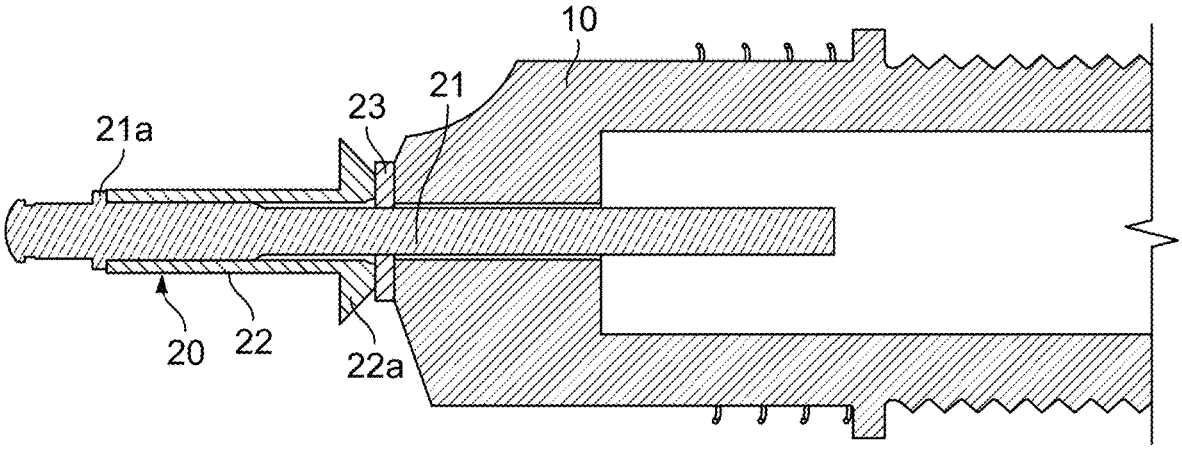

With reference to FIGS. 1A and 1B, a gripping head 10 for a conventional installation tool for aerospace fastener 20 is shown. Head 10 is typically carried in the muzzle end of an installing tool, and that head may be oriented to operate on a straight feed, an offset feed, or at right angle between the tool housing. The head 10 has an elongate, cylindrical shape, and any variety of motors or drivers may be provided to engage the proximal end of the pin 21 to initiate a reciprocating action in which jaws grip and remove the proximal end of the pin 21. Notably, pin 21 is surrounded by and moves within a sleeve 22, which itself includes an enlarged head 22*a*. A locking ring or anvil 23 is associated with the head 22*a*, while an engagement feature 21*a* on or near the distal end of the pin 21 so as to deform the sleeve 22.

Head 10 includes a pin aperture 11 sized to receive the proximal end of the pin 21. Conventional means (not shown) are provided within the driving mechanism of the tool to pull and/or twist the pin 21 until the proximal end shears off (also see FIG. 3B). The head 10 may be aligned straight with the muzzle or at offset or right angles to the grip of the tool itself. Generally, the muzzle is positioned in the same direction in which the pulling head reciprocates/moves.

Retaining a narrow and comparatively elongate profile to the head 10 is critical to certain aspects of the invention. That is, the nature of how aerospace fasteners are deployed requires the user to be able to maneuver and manipulate the tool in compact spaces. Thus, the inventors appreciated that mechanisms like the one contemplated in U.S. Pat. No. 9,987,714 may not be practical, especially with regard to the installation of blind bolts and rivets having anvils.

Figure 2A:
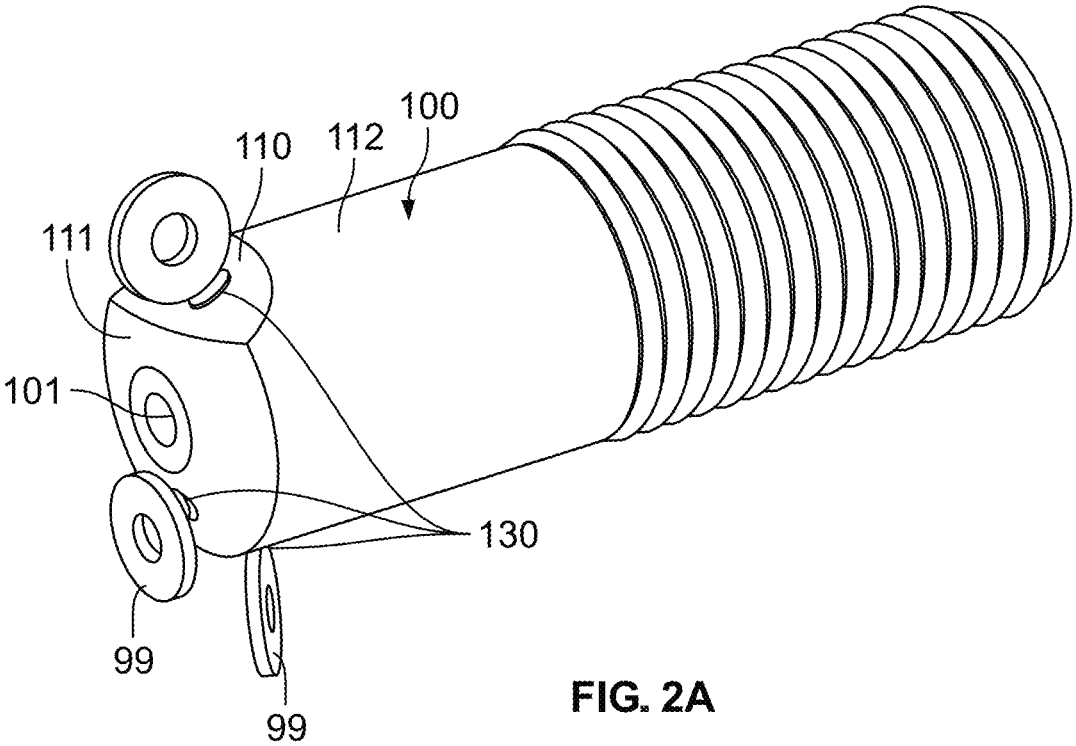
FIGS. 2A and 2B are perspective views of a tool head according to certain aspects of the invention.
Figure 2B:
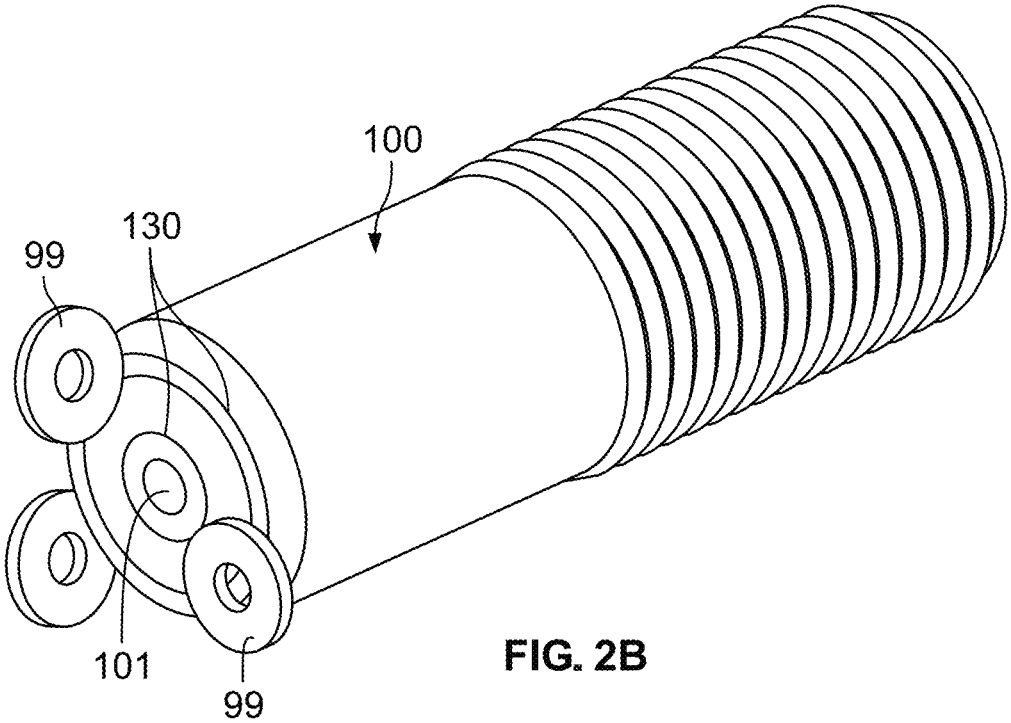

As seen in FIGS. 2A and 2B, the inventors propose to provide magnetized strips to the existing surfaces of the tool head. In particular, head 100 includes pin aperture 111 a scalloped edge 110 positioned around the periphery of the engagement aperture 120. Magnets 130 may be positioned on the work piece facing edge 111, on the cylindrical sidewall 112, and/or along the sloped or curving facing of the scalloped edge 110. The magnets 130 will be spaced apart and selected to have sufficient magnetism to capture anvils and/or other particulates 99 (i.e., foreign object debris or FOD) generated by the installation process. In some aspects, anywhere from two, three, four, five, six, seven, eight, nine, ten, or up twenty discrete magnets are placed at likely capture points. In this manner, the debris is reliably and regularly captured without falling onto or into the work pieces.

Magnets may be temporary/permanent magnets or electromagnets. When the latter are employed, the electromagnetic coils may be coupled to the power source driving the hand held tool, with actuation of the magnets synchronized to the trigger actuator used to engage/install the fastener. Other appropriate magnet types include neodymium iron boron, ceramic, ferrite, alnico, or samarium cobalt. If electromagnets are employed, the system can be configured to periodically release FOD by shutting off the current (i.e., temporarily releasing magnetism), while embodiments relying on the pneumatic removal of FOD can further synchronize with the electromagnet activation/deactivation so that suction is applied when magnetic force is released. In all cases, the strength of the magnet should be sufficient to capture FOD but without interfering (or becoming attracted to) the work pieces being joined.

In the arrangement illustrated in FIG. 2B, head 101 is formed as circular cylinder (i.e., no scalloped edge). In this manner, it becomes possible to provide concentric and/or coaxial annular magnets. Here, the magnets are provided on the work piece facing edge 111. Nevertheless, additional magnets could also be provided on the sidewall 112.

Because installation tools are typically employed to install a plurality of fasteners in quick succession, simply providing magnets may be insufficient to meet the practical reality in using these tools. Therefore, as a further aspect, the inventors propose a number of collection systems as shown in FIGS. 3A through 6B. It will be understood these systems can be used in addition to the configuration of FIGS. 2A and 2B, as well as the other aspects contemplated herein.

Figure 3A:
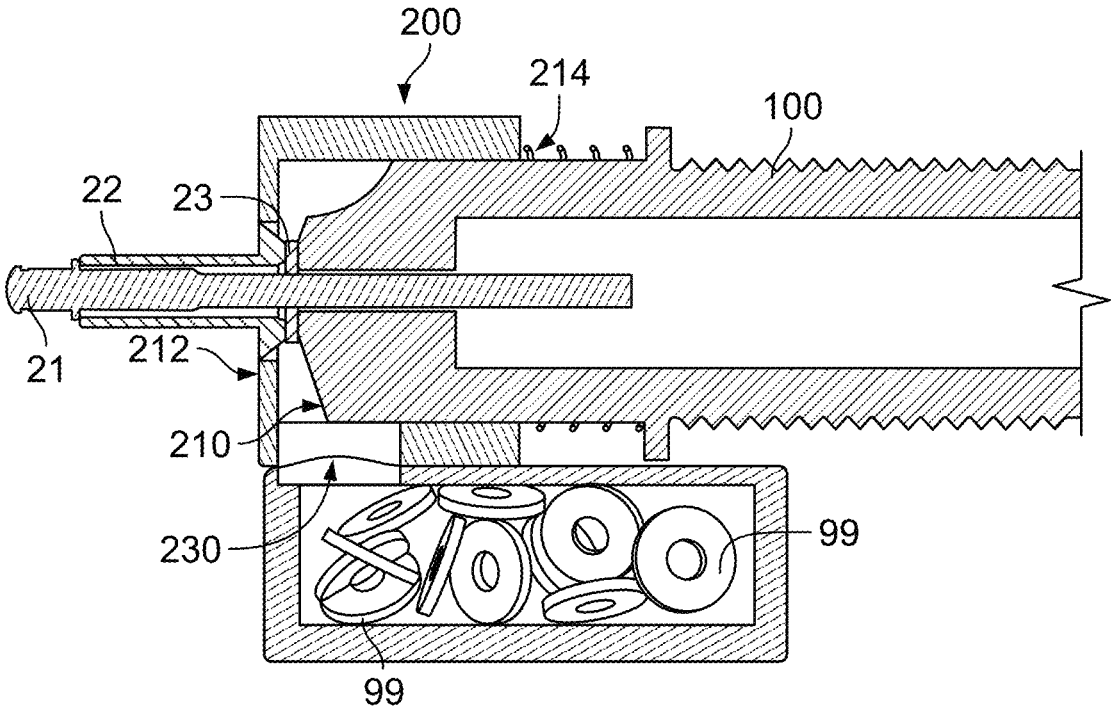
FIGS. 3A and 3B are cross sectional side views of the tool head of FIG. 2A configured with a collection bin, with the former illustrating the arrangement immediately prior to installation of the fastener and the latter showing the arrangement after installation of the fastener with the pin removed and the anvil in the process of being transferred to the collection bin.

For example, a collection bin 200 can be affixed to the head 100 by way of a screw or snap-fitting, although other attachment means are possible. The head 100 reciprocates within an upper engagement chamber 210. At opposing ends of the chamber 210, a fastener aperture 212 and head aperture 214 are aligned along the axis of reciprocation for the head 100. As seen in FIG. 3A, either by mechanical force provided by the tool driver or by the user pressing the tool against the work piece surface, the head 100 advances toward the fastener 20, which is partially received in the aperture 212. This initial movement allows the head 100 to engage the pin 21 and perform the installation process described above.

Figure 3B:
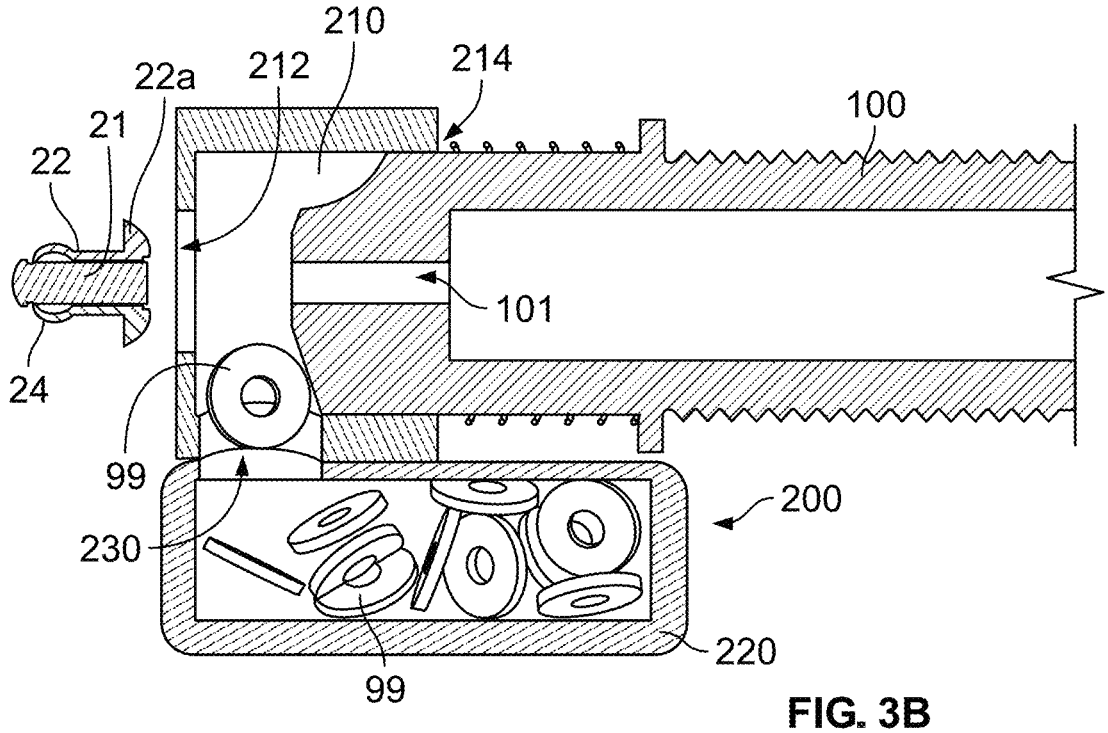

As seen in FIG. 3B, the installation process results in removal of the pin 21 (no longer shown). The style of fastener illustrate in FIG. 3B contemplates a break bolt and commensurate formation of a retention bulb 24 on the distal end of the fastener 20, thereby clamping the work piece (also not shown) in between the bulb and the head of the sleeve 22*a*.

Because the head 100 may slide (or be forced by the regular reciprocating motion of the tool) along the axis of the apertures 212, 214, any FOD 99 (e.g., anvil, particulates, etc.) captured by the magnets 130 on the head 100 can be dislodged by the inner facings of the chamber 210.

A collection compartment 220 is provided underneath or partially or completely around the engagement chamber 210, with a slot 230 configured to allow dislodged FOD to fall off of the head 100 and into the compartment 220. The compartment 220 may have an arcuate or annular shape, with a continuous connection slot 230 or series of individual slots (not shown).

The compartment 220 may be permanently affixed to the engagement chamber 210 or, more preferably, the compartment 220 has a modular construction that allows for quick and easy "change out" once it is filled. Thus, the compartment 220 may be snap or slide fitted, via bead, grooves, slots, and the like provided on the interfacing surfaces of the housings forming the chamber 210 and compartment 220.

In other aspects, the compartment 220 may be formed as or connected to a pneumatic collection system. This pneumatic system operates at a pressure differential (e.g., a partial vacuum) to remove FOD 99 from the chambers 210, 220. Notably, because the pressure is only needed to remove already detached FOD, it is not necessary to form a seal (or even provide particularly strong suction) between the workpiece and the tool/head 100. A pneumatic connection housing 240 can be provided on the tool and adjacent to the compartment 220. A vacuum line draws airs and FOD 99 out of the compartment 220 and into a larger storage space in the housing 240. Additionally or alternatively, the line 241 can pull FOD 99 completely out of the housing 240 for final disposal or recycling, with a similar line 242 possible for removing discarded portions of pins 21.

Figure 4:
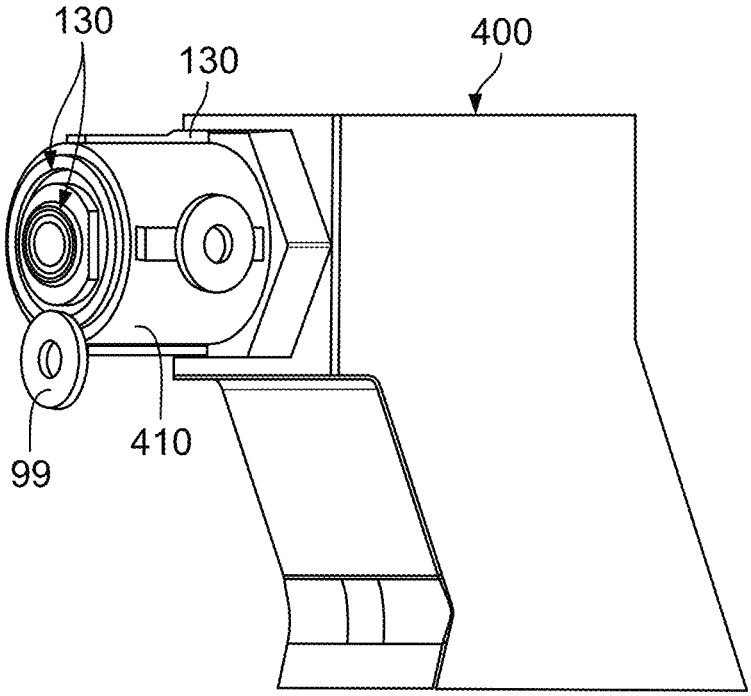
FIG. 4 is a perspective view of the tool with a modified housing.
Figure 5:
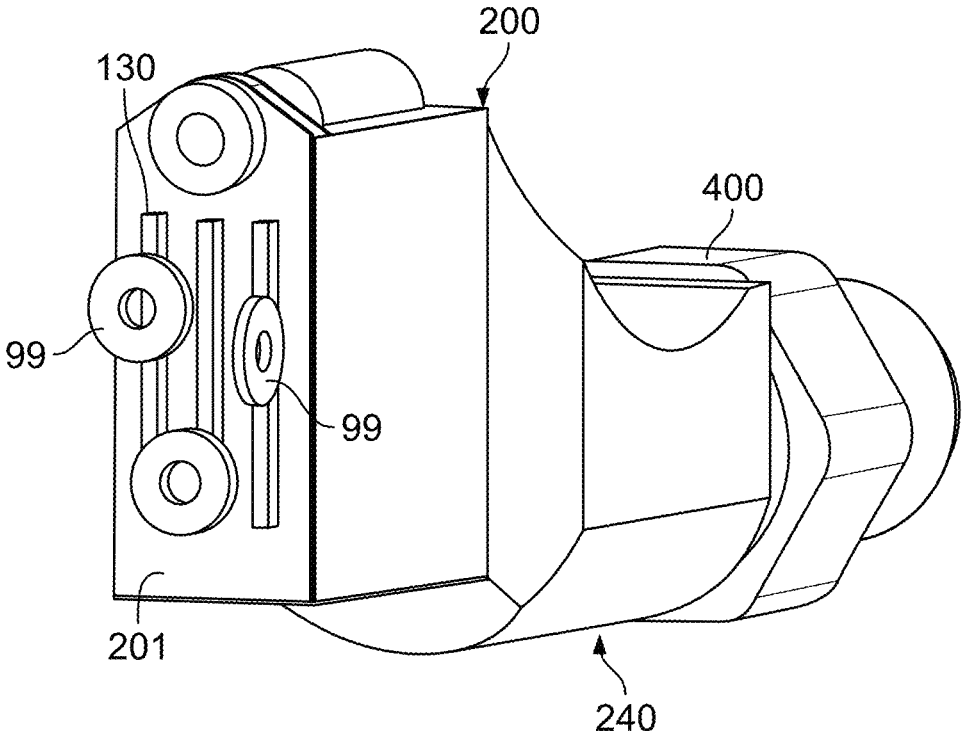
FIG. 5 is a perspective view of the tool and collection bin with a modified housing.

FIG. 4 shows a further concept in which magnets 130 are also provided on the tool housing 400 (note that this housing is distinct from the collection bin 200), and FIG. 5 contemplates a similar arrangement on the outer facings of the collection bin 200. Manual removal of collected FOD 99 may be necessary in both cases, although these configurations could be implemented in combination with other aspects disclosed herein to serve as an additional safeguard against FOD contamination.

In FIG. 4, head 100 is surrounded by housing 400, which conforms to the general, elongated shape of the head 100. In some aspects, the head may protrude and/or retract from the muzzle 310. Annular and strip sized magnets 130 are positioned on the muzzle 410.

In FIG. 5, the hand held installation tool is fitted with a collection bin 200 similar to those contemplated in FIGS. 3A and 3B. Here, the front facing 201 of the bin 200 is provided with elongated, spaced apparent magnet strips 130. While not shown, a similar approach can be employed on the sides, top, and/or bottom of the housing 200. As noted above, an additional storage and FOD removal housing 240 can be provided.

Figure 6A:
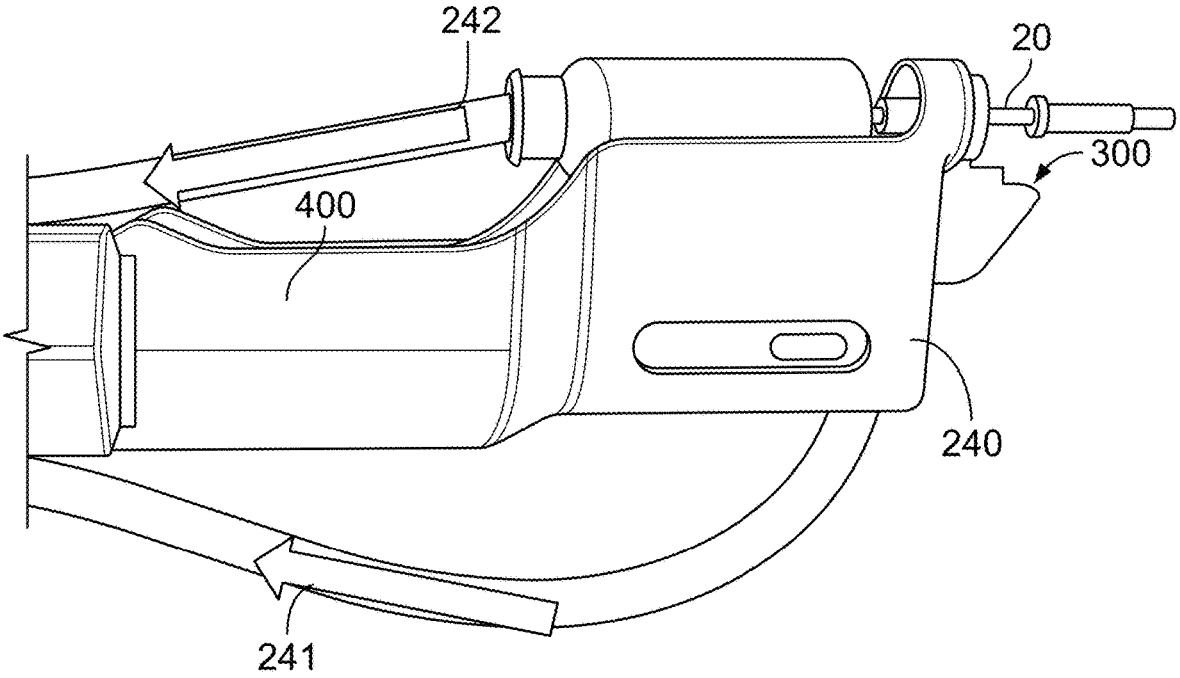
FIG. 6A is a side illustration of the hand held tool, including the collapsible pneumatic collector and the pneumatic connections for removal of collected and discarded pins and anvils.
Figure 6B:
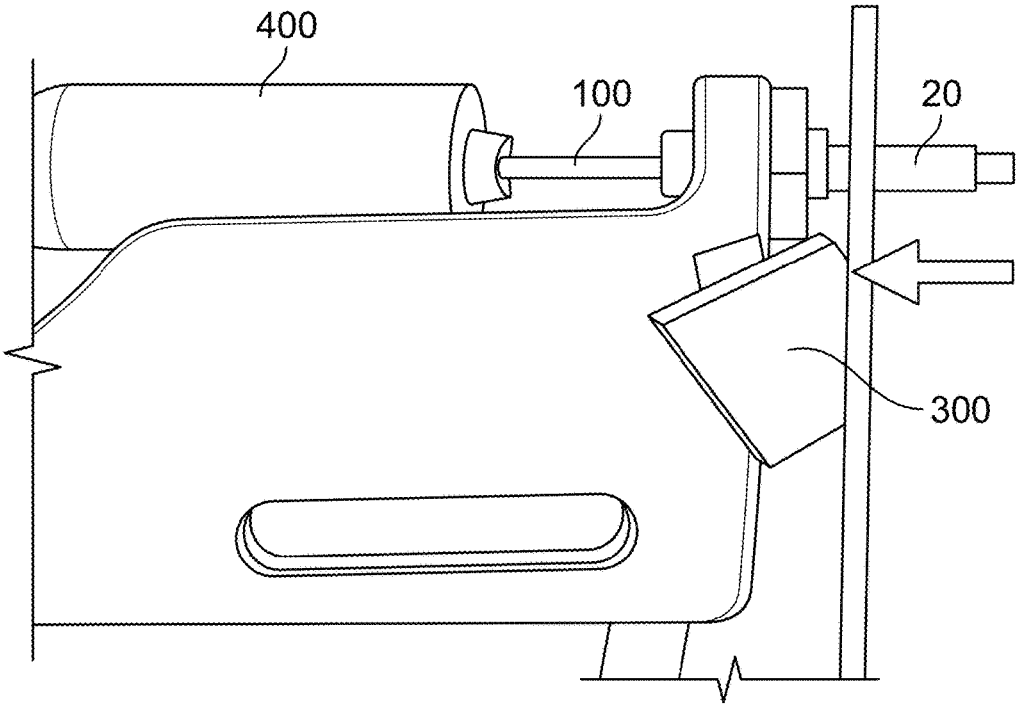
FIG. 6B is a complimentary side illustration of the hand held tool of FIG. 6A pressed against a work piece to collapse the pneumatic collector.

A further iteration of the collection compartment is shown in FIGS. 6A and 6B. Note that pneumatic connections can be provided to allow for the removal of discarded pins separately from FOD generated by the removal of the anvil (or otherwise), preferably by lines 241, 242. Here, a collapsible or hinged pocket 300 is provided as part of the FOD collection system. Pocket 300 may be made of rubber, suitably durable fabric, or other resilient materials. In the alternative, a wedge shaped member can pivot with its top edges riding along a track or other defined path. In either instance, the pocket 300 collapses as the tool is pressed toward the work piece (as part of installing the fastener 20), although sufficient open space at the top of the pocket insures that any and all FOD 99 will fall into the pocket 300 (unless it is first captured by a magnet 130).

Notably, all of the foregoing aspects can and should be implemented or retrofitted onto existing, hand-held tools. This approach avoid the need to create a separate machine or platform, so that current production lines will not be disrupted. Further, because the system uses magnets arrayed completely around the head 100, the system is highly effective at capturing all FOD. Further, the system is not dependent upon creating suction around and between the work piece and the tool.

What has been described above and in the attachments include various examples. It is, of course, not possible to describe every conceivable combination of components or methodologies for purposes of describing the present specification, but one of ordinary skill in the art may recognize that many further combinations and permutations of the present specification are possible. Each of the components described above may be combined or added together in any permutation to define embodiments disclosed herein. Accordingly, the present specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A system for installing frangible aerospace fasteners in work pieces without depositing foreign object debris thereon, the system comprising:

a hand-held or portable installation tool having a elongate muzzle member having a pulling head with an aperture configured to receive a pin from an aerospace fastener and wherein the muzzle member is connected a drive motor configured to remove the pin from the aerospace fastener;

one or more magnets are affixed on the pulling head around the aperture.

2. The system of claim 1 wherein the magnets are electromagnets.

3. The system of claim 2 further comprising a pneumatic system configured to remove collected debris when current is not applied to the electromagnet.

4. The system of claim 1 wherein at least one annular magnet is positioned around the periphery of the aperture.

5. The system of claim 4 wherein the collection bin includes a collection chamber in which the pulling head reciprocates through a horizontal axis thereof as the installation tool is actuated and a storage chamber positioned beneath the collection chamber.

6. The system of claim 5 further comprising a pneumatic system connected to the collection bin so as to periodically remove collected debris.

7. The system of claim 5 wherein the storage chamber has an arcuate or annular shape so as to partially or completely enclose the collection chamber.

8. The system of claim 5 wherein the storage chamber is modular so as to allow for removal and replacement of the storage chamber from the collection bin.

9. The system of claim 5 wherein one or more magnets are affixed to one or more outer surfaces of the collection bin.

10. The system of claim 1 wherein a plurality of strip magnets are affixed at regular intervals around the aperture.

11. The system of claim 1 wherein additional magnets are affixed to any or all of: the top, bottom, and sidewalls of a housing for the tool.

12. The system of claim 1 wherein additional magnets are affixed to any or all of: an terminal facing and a sidewall of the muzzle member.

13. The system of claim 1 further comprising a collection bin affixed to the muzzle.

14. The system of claim 13 wherein the collection bin is a collapsible or pivoting pocket positioned immediately beneath the aperture.

15. The system of claim 14 further comprising a pneumatic system connected to the pocket so as to periodically remove collected debris.

16. The system of claim 1 further comprising a pneumatic system configured to remove collected debris.

17. The system of claim 16 wherein the pneumatic system includes a first line for removing discarded pins from inside the elongate muzzle member and a second line for removing other collected debris from areas proximate to the magnet(s).

* * * * *